United States Patent [19]

Konig et al.

[11] Patent Number: 4,864,694

[45] Date of Patent: Sep. 12, 1989

[54] APPARATUS FOR CONTROLLING THE SLIVER DRAFTING ARRANGEMENT IN A TEXTILE DRAW FRAME

[75] Inventors: Herbert Konig, Ebersbach/Fils; Gerhard Stahle, Adelberg, both of Fed. Rep. of Germany

[73] Assignee: Zinser Textilemaschinen GmbH, Fed. Rep. of Germany

[21] Appl. No.: 109,759

[22] Filed: Oct. 16, 1987

[30] Foreign Application Priority Data

Oct. 17, 1986 [DE] Fed. Rep. of Germany ..... 3635341

[51] Int. Cl.[4] ..... D01H 5/38; D01H 5/42

[52] U.S. Cl. ..... 19/240; 19/0.27; 19/239

[58] Field of Search ..... 19/239, 240, 0.27

[56] References Cited

U.S. PATENT DOCUMENTS

| | | | |
|---|---|---|---|
| 2,542,331 | 2/1951 | Hiensch | 19/240 |
| 3,676,295 | 7/1972 | Rice | 19/0.27 X |
| 4,369,550 | 1/1983 | Meile | 19/240 |
| 4,473,924 | 10/1984 | Hartmannsgruber et al. | 19/240 |
| 4,653,153 | 3/1987 | Felix et al. | 19/240 |
| 4,703,431 | 10/1987 | Salo et al. | 19/240 X |

FOREIGN PATENT DOCUMENTS

| | | |
|---|---|---|
| 2941612 | 4/1981 | Fed. Rep. of Germany . |
| 3035196 | 4/1981 | Fed. Rep. of Germany . |
| 3417779 | 12/1984 | Fed. Rep. of Germany . |
| 2571066 | 4/1986 | France . |

OTHER PUBLICATIONS

DE-Z "Melliad Textilbericht" 8, 1964, p. 873.

*Primary Examiner*—Louis K. Rimrodt

[57] ABSTRACT

An apparatus for controlling the drafting of sliver in a draw frame wherein a control arrangement generates an adjusting signal in response to sliver mass variations to correspondingly vary the sliver draft. A modifying arrangement is provided for selective manual or automatic adjustment according to any given one or more operating parameters which influence the sliver drafting, such as physical characteristics of the sliver and environmental characteristics of the textile machine, to modify the operation of the control arrangement to correct the adjusting signal and thereby to further vary the drafting of the sliver to compensate for the operating parameters.

17 Claims, 2 Drawing Sheets

Fig. 2
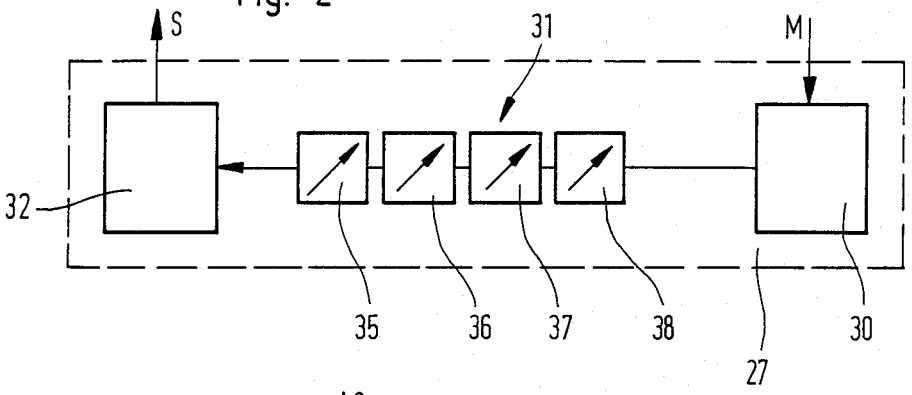
Fig. 3
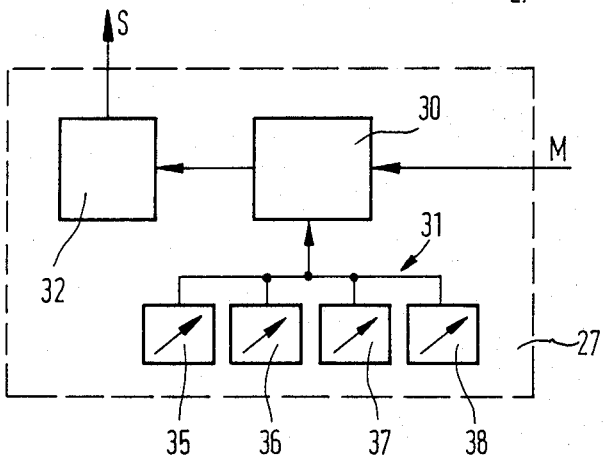
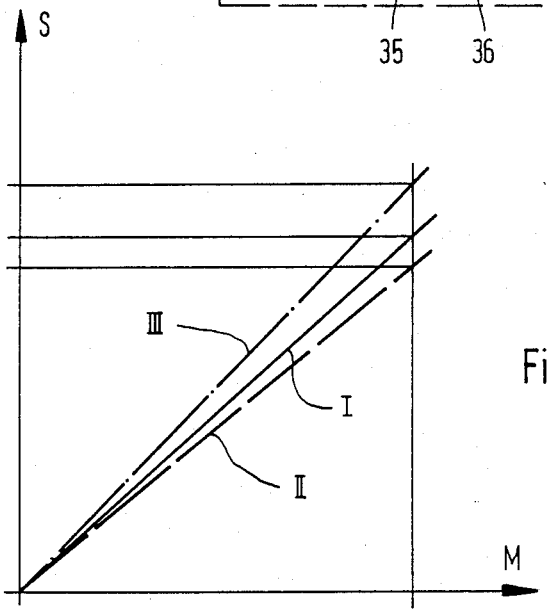
Fig. 4

APPARATUS FOR CONTROLLING THE SLIVER DRAFTING ARRANGEMENT IN A TEXTILE DRAW FRAME

BACKGROUND OF THE INVENTION

The present invention relates to apparatus for controlling the drafting mechanism of a sliver in a textile draw frame to reduce the variations in mass thereof, commonly referred to in the textile industry as an auto-leveling apparatus, and more particularly to an arrangement for use in such apparatus for additionally compensating for operating parameters other than mass variations which also affect the sliver draft, such as physical characteristics of the sliver and environmental characteristics of the textile machine.

Known prior art is disclosed in U.S. patent application Ser. No. 69,247, entitled "A Method And Apparatus For Controlling The Drafting Of Sliver In A Drawing Frame" filed July 2, 1987, by Konig et al, of common overship which is the U.S. counterpart of West German patent applicaton P No. 36 22 584.3. This invention provides two sensing devices, one which senses the variations in the mass characteristics of sliver in advance of the drafting mechanism and another which senses the differences in mass per unit length of the sliver following the drafting mechanism. The sensed variations and differences are fed to a regulating device which generates a control signal to vary the draft of the drafting mechanism to compensate for variations in mass of sliver in response to the sensed variations in a time-delayed manner and for the difference of the sensed mass per unit length and a selectable theoretical value for mass per unit of length.

Additional prior art is disclosed in German unexamined application No. 30 35 196. This invention teaches a sensing device for sensing the sliver density and generating a signal to a regulating means. The regulating means generates an adjusting signal as a function of the silver density signal, the drawing-off speed of the sliver, and the speed of rotation of the drafting arrangement to control drafting arrangement so that the sliver produced is of a constant density.

Both of these prior art systems control the drafting of sliver in response to the sensing of variations in mass of the silver or variations in the density of the sliver prior to drafting and combining these sensed variations with other signals such as the sensed mass variations after drafting or the speed of rotation of the drafting arrangement but none of the prior art takes into consideration operating parameters other than variations in sliver mass or density, nor do they consider environmental conditions.

SUMMARY OF THE INVENTION

It is accordingly an object of the present invention to provide an apparatus for controlling the drafting arrangement in a textile draw frame which can be easily adjusted to compensate for one or more operating parameters other than sliver mass variations which influence silver draft to produce a more uniform sliver.

Briefly described, the apparatus of the present invention comprises a control arrangement which senses variations in mass characteristics of the sliver upstream of the drafting mechanism and is operatively associated with the drafting mechanism for varying operation thereof to compensate for the sensed mass variations. The apparatus also includes an arrangement for modifying the operation of the control arrangement in further compensation for at least one operating parameter other than sliver mass variations which influences the drafting of the sliver.

Preferably, the operating parameter or parameters for which the modifying arrangement compensates are physical characteristics of the sliver and/or environmental characteristics of the surroundings of the textile machine. For example, such physical characteristics of the sliver may include the fineness of the silver fibers, the strength of the sliver, the sliver coefficient of adhesion and the sliding coefficient of the sliver. Environmental characteristics for which compensation may be made may include the ambient air temperature and the ambient humidity.

The control arrangement preferably includes a sensing device for detecting the sliver mass variations and for generating a measuring signal, a control device for receiving the measuring signal and for producing an output signal in response thereto, and an actuating device for receiving the output signal of the control device and for generating an adjusting signal to the drafting mechanism for varying the drafting of the silver in response thereto. The modifying arrangement includes a selectively adjustable correcting device having at least one and preferably a plurality of adjusting elements for individual adjustment in relation to a respective one or plurality of operating parameters, the adjustable correcting device being operatively associated with the control arrangement for producing a corrected adjusting signal according to the operating parameter or parameters for which compensation is to be made. In one embodiment of the present invention, the adjustable correcting device is operatively arranged in series between the control device and the actuating device. In an alternate embodiment, the adjustable correcting device is operatively connected to either the control device or the actuating device or is connected commonly with both. The individual adjusting elements may be connected in parallel with one another or in series with one another. The adjustable correcting device preferably includes an arrangement for displaying a visual indication of the value of the operating parameter at which the device is set and an arrangement for storing adjusted values of the operating parameters. For example, the adjustable correcting device may be a microcomputer having a computer terminal with a display screen. The modifying arrangement may also include an arrangement for detecting the operating parameters and automatically adjusting the adjustable correcting device in relation thereto.

Other features and advantages of the invention are apparent from the following detailed description of the preferred embodiments of the present invention and from the accompanying drawings.

BRIEF DESCRIPTION OF THE DRAWINGS

FIG. 2 is a schematic diagram of a second embodiment of the drafting control apparatus of the present invention;

FIG. 3 is a schematic diagram of a third embodiment of the drafting control apparatus of the present invention; and FIG. 4 is a graphical representation of the relationship between the measuring signal of the sensing device and the adjusting signal of the actuating device in the present drafting control apparatus.

DETAILED DESCRIPTION OF THE PREFERRED EMBODIMENT

Figure 1:
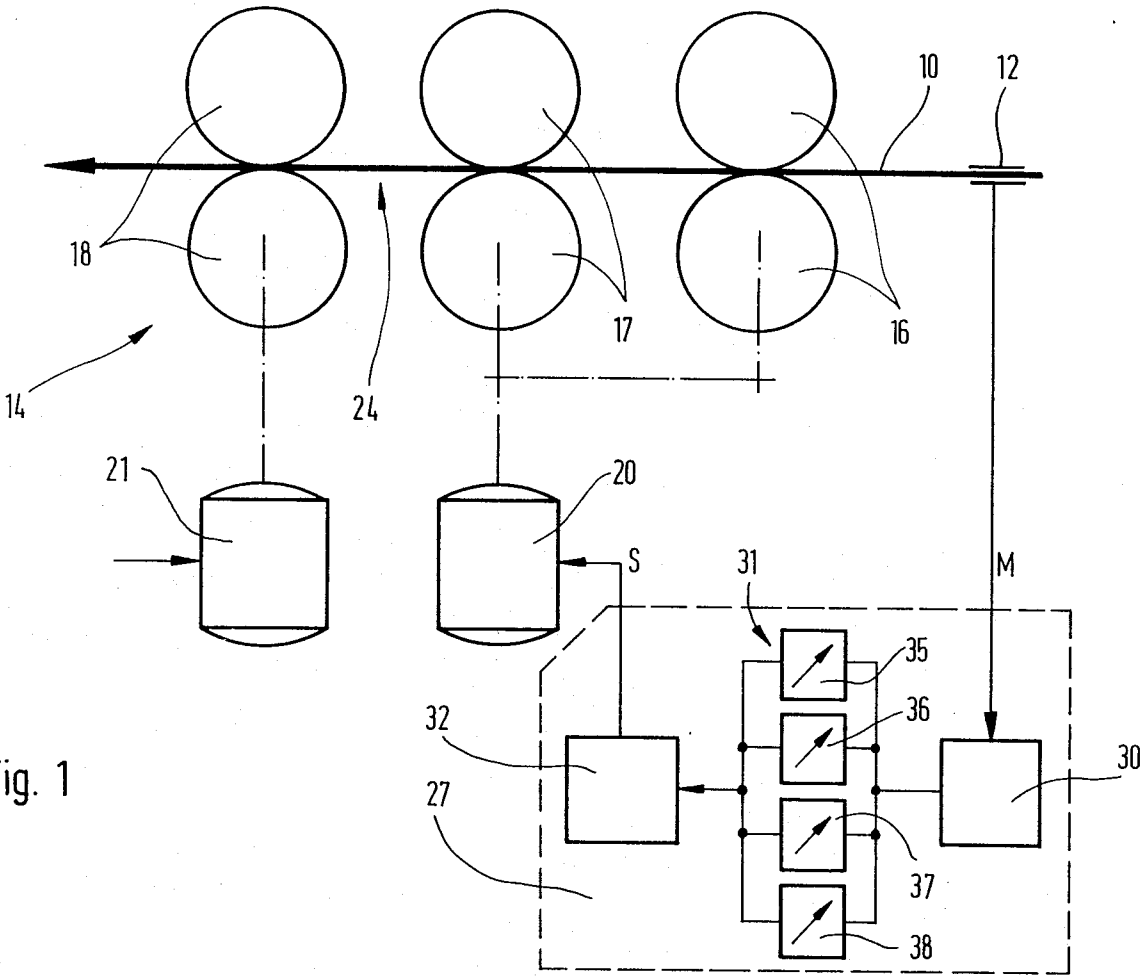
FIG. 1 is a schematic diagram of a drafting control apparatus for a textile draw frame or like machine according to one embodiment of the present invention.

Referring now to the accompanying drawings and initially to FIG. 1, a drafting mechanism such as commonly utilized in a textile drawing frame is schematically illustrated generally at 14 in association with a draft control apparatus according to the present invention, shown generally at 27. The drafting mechanism 14 includes three serially arranged pairs of drafting rollers 16,17,18 driven by two electric motors 20,21. The control apparatus 27 basically includes a sensing device 12, a control device 30, a modifying arrangement 31 and an actuating devicd 32. In basic operation, a traveling sliver 10 is trained to travel first through the sensing device 12 and then in sequence through the three pairs of drafting rollers 16,17,18. The downstream pair of drafting rollers 18 are driven by the electric motor 21 at a constant speed while the two upstream pairs of drafting rollers 16,17 are commonly coupled to the electric motor 20 which is arranged for variable speed operation for driving the drafting rollers 16,17 at a variable speed. The two electric motors 20,21 and, in turn, their associated draft rollers 16,17,18 are driven at different speeds to create a drafting area 24 between the downstream pairs of drafting rollers 17,18 in which area the silver 10 is drawn or drafted. The draft of the silver 10 can be varied and thus regulated in the drafting area 24 by changing the speed of at least one of the two electric motors 20,21.

The speed of the motor 20 and therewith the draft of the sliver 10 is controlled by the control apparatus 27 by the generation of an adjusting signal S formed as a function of a measuring signal M generated by the sensing device 12. The sensing device 12 is adapted to detect the variations in mass of the sliver 10 and to produce the measuring signal M as a representation of sensed sliver mass variations. The control apparatus 27 is adapted to produce the adjusting signal S to in turn vary the rotational speed of the drafting rollers 16,17 as necessary to adjust the draft of the drafting mechanism 14 to reduce the variations in mass of the sliver 10 and, if possible, to prevent their reoccurrence.

FIG. 1 represents one embodiment of the present invention wherein the control apparatus 27 has the control device 30, the modifying arrangement 31 and the actuating device 32 connected in series with one another. The control device 30 is arranged to receive the measuring signal M produced by the sensing device 12 and to produce an output signal in response thereto which is fed to the actuating device 32 for generating the adjusting signal S to the drafting mechanism 14 in response to the output signal of the control device 30. The relationship between the measuring signal M and the adjusting signal S is illustrated in the graph of FIG. 4, in which the measuring signal M is represented by the abscissa of the coordinate system and the adjusting signal S is represented by the ordinate.

The relationship between the measuring signal M and adjusting signal S is predetermined and stored in the control device 30 of the control apparatus 27. This relationship is illustrated by the solid line I in FIG. 4 and is theoretically determined. The basic relationship illustrated by the solid line I in FIG. 4 associates a value for the adjusting signal S with every possible value for the measuring signal M, this relationship of the adjusting signal S being selected to compensate for the variations of mass of the silver 10 as sensed by the sensing device 12 taking into account a certain time delay which corresponds to the travel time of the sliver 10 from the sensing device 12 to the drafting area 24.

As those persons skilled in the art will recognize, if operating parameters other than sliver mass variations change during the course of the drafting operation e.g. a change in the ambient temperature of the textile machine from a normal operating temperature, such changes may also influence the sliver draft uniformity. According to the present invention, such changes inoperating conditions may be compensated for by the modifying arrangement 31 which preferably includes an adjustable device for selective setting by a machine operator or other personnel according to any prevailing operating parameter having an influence on the drafting operation so as to desirably warrant correction. This causes the relationship I stored in the control device 30 and the output signals thereof to be corrected by the modifying arrangement 31 to a new signal value relationship indicated by the broken line II in FIG. 4. In turn, the actuating device 32 produces a corrected adjusting signal S to the motor 20 based on the correction made by the modifying arrangement 31 in the output signal from the control device 30. In this manner, the control apparatus 27 can compensate for any given operating parameter to produce a corrected adjusting signal S for more precise drafting of the sliver 10. The basic relationship between the measuring signal M and the adjusting signal S remains unchanged. Instead, the modifying device 31 acts to modify or translate the basic relationship according to the operating parameter for which compensation is to be made.

Thus, according to the present invention, the modifying arrangement 31 may be setup as necessary or desirable to make correcting compensation for virtually any operating parameter or combination thereof affecting the sliver drafting process in addition to the basic correction for sliver mass variations for which the control device 30 is programmed. As noted, environmental operating parameters such as the ambient temperature and/or the ambient humidity surrounding the textile machine may be compensated if changes occur. Similarly, changes in the physical characteristics of the sliver material such as the fineness of the sliver fibers, the strength of the silver, the coefficient of adhesion of the sliver and the coefficient of sliding of the sliver may be compensated. For any such operating parameter, the relationship between the measuring signal M and the adjusting signal S will thus be corrected to a new relationship as aforementioned, e.g. as illustrated by the dotted and dash lines III in FIG. 4.

In summary, in the embodiment of the present control apparatus of FIGS. 1 and 2, the control device 30 produces an output signal in response to the measuring signal M, the output signal being determined according to the relationship defined by the solid line I in FIG. 4. The output signal of the control device 30 is then corrected if and as necessary by the modifying arrangement 31 in order to compensate for one or more prevailing environmental characteristics and/or physical characteristics of the sliver 10 as set in the modifying arrangement 31, resulting in a modification of the relationship I as depicted by the broken lines II and III of FIG. 4. The corrected output signal is then received by the actuating device 32 which transforms the output signal into an adjusting signal S which controls the operation of the motor 20 and consequently the speed of rotation of the two pairs of drafting rollers 16,17.

Preferably, the control device 30 of the control apparatus 27 is an electronic circuit with an input/output characteristic as defined by the solid line I in FIG. 4, and the modifying arrangement 31 includes a plurality of individual adjusting elements 35,36,37,38 preferably, individual potentiometers. The actuating device 32 also is an electronic circuit capable of handling the load of the motor 20.

The individual adjusting elements 35,36,37,38 of the modifying arrangement 31 can be connected to each other in parallel as shown in FIG. 1 and thus commonly correct the output signal generated by the control device 30 or, as shown in FIG. 2, the individual adjusting elements 35,36,37,38 may be connected in series with one another to sequentially correct the output signal generated by the control device 30.

In another embodiment of the preferred invention illustrated in FIG. 3, the control device 30 and the actuating device 32 are directly connected to one another, with the modifying device 31 being directly connected to the control device 30. The adjusting elements 35,36,37,38 of the modifying arrangement 31 being connected to the control device 30 in this manner directly influence the formation of the output signal of the control device 30. As will be recognized by one skilled in the art, the modifying arrangement 31 can also be connected directly to the actuating device 32 or to both the control device 30 and the actuating device 32.

Each of the individual adjusting elements 35,36,37,38 is provided with a scale, visual display indicator or the like for indication of the value of the respective operating parameter being adjusted by the adjusting element. Thus, the particular setting or settings of the individual adjusting elements 35,36,37,38 can be recorded once properly established and the elements 35,36,37,38 may then be readily reset precisely to the same setting with the aid of the visual display indicators without any experimentation or wasted effort at any later time when sliver material having the same physical characteristics is to be processed and/or the prevailing ambient environmental characteristics are the same.

Certain parameters which influence the drafting of the sliver 10 such as the air temperature and/or the humidity of the environment of the textile machine, can be detected by appropriate measuring elements (not shown) and, as desirable, these measuring elements can be connected to the modifying arrangement 31 for transmission of a signal thereto corresponding to the measured value of the parameter. Thus, such parameters may be automatically detected and taken into consideration during the generation of the adjusting signal S without the necessity of manual setting of the adjusting elements by a machine operator.

For the above purposes, a microcomputer having an operator terminal and a display screen may advantageously be utilized as the modifying arrangement 31 to considerably simplify recording and storage of data and the adjusting of the operating parameters which influence the drafting of the silver 10. In this manner, parameters which have been detected or have been found to be advantageous in drafting a sliver having particular physical characteristics and/or under particular environmental operating conditions can be stored and retrieved at andy time by a microcomputer, such as when the same type sliver is to be processed. For example, several parameters, such as the physical characteristics of a particular type of sliver, may be combined and stored under a code word in the microcomputer for latter retrieval and use to generate the adjusting signal S according to the operating parameters. Finally, it is possible with the aid of a microcomputer to store the basic relationship I (FIG. 4) between the measuring signal M and the adjusting signal S and to form the adjusting signal S as a function of the measuring signal M as well as the selected operating parameters which influence the drafting of the sliver 10.

It will therefore be readily understood by those persons skilled in the art the the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

We claim:

1. In a textile draw frame or like textile machine having means for drafting a traveling sliver, apparatus for controlling said drafting means to regulate the draft of said sliver, comprising:

control means for sensing variations in mass characteristics of said sliver upstream of said drafting means and operatively associated with said drafting means for varying operation thereof to compensate for sensed mass variations, and means for modifying operation of said control means in further compensation for at least one physical characteristic of said sliver other than sliver mass variations which influences the draftability of said sliver, said physical characteristic being at least one of the properties of the fineness of the fibers of said sliver, sliver strength, a coefficient of adhesion of said sliver, and a coefficient of sliding of said sliver.

2. Apparatus for controlling drafting means in a textile draw frame or like textile machine according to claim 1 and characterized further in that said modifying means is arranged for modifying operation of said control means in further compensation for an environmental characteristic of said textile machine.

3. Apparatus for controlling drafting means in a textile draw frame or like textile machine according to claim 2 and characterized further in that said environmental characteristic is at least one of the characteristics of ambient air temperature and ambient humidity.

4. Apparatus for controlling drafting means in a tetile draw frame or like textile machine according to claim 1 and characterized further in that said modifying means includes means for selective adjustment in relation to said physical characteristic.

5. Apparatus for controlling drafting means in a textile draw frame or like textile machine according to claim 1 and characterized further in that said modifying means is arranged to modify operation of said control means in compensation for a plurality of said physical characteristics.

6. Apparatus for controlling drafting means in a textile draw frame or like textile machine according to claim 5 and characterized further in that said modifying means includes a plurality of adjusting elements for individual adjustment in relation to a respective plurality of physical characteristics.

7. Apparatus for controlling drafting means in a textile draw frame or like textile machine according to claim 1 and characterized further in that said control means comprises a sensing device for detecting silver mass variations and for generating a measuring signal, a control device for receiving said measuring signal and for producing an output signal in response thereto, and an actuating device for receiving said control device output signal and for generating an adjusting signal to said drafting means in response thereto, and said modifying means comprises a selectively adjustable correcting device operatively associated with said control means for producing a corrected adjusting signal according to said physical characteristics.

8. Apparatus for controlling drafting means in a textile draw frame or like textile machine according to claim 7 and characterized further in that said adjustable correcting device is operatively arranged in series between said control device and said actuating device.

9. Apparatus for controlling drafting means in a textile draw frame or like textile machine according to claim 7 and characterized further in that said adjustable correcting device is operatively connected to at least one of said control device and said actuating device.

10. Apparatus for controlling drafting means in a textile draw frame or like textile machine according to claim 7 and characterized further in that said adjustable correcting device comprises a plurality of individual adjusting elements.

11. Apparatus for controlling drafting means in a textile draw frame or like textile machine according to claim 10 and characterized further in that said adjusting elements are arranged in parallel with one another.

12. Apparatus for controlling drafting means in a textile draw frame or like textile machine according to claim 10 and characterized further in that said adjusting elements are arranged in series with one another.

13. Apparatus for controlling drafting means in a textile draw frame or like textile machine according to claim 7 and characterized further in that said adjustable correcting device includes means for displaying a visual indication of the value of said physical characteristic.

14. Apparatus for controlling drafting means in a textile draw frame or like textile machine according to claim 7 and characterized further in that said modifying means includes means for detecting said physical characteristic and automaticalldy adjusting said adjustable correcting device in relation thereto.

15. Apparatus for controlling drafting means in a textile draw frame or like textile machine according to claim 7 and characterized further by means for storing adjusted values of said physical characteristic.

16. Apparatus for controlling drafting means in a textile draw frame or like textile machine according to claim 15 and characterized further in that said adjustable correcting device comprises a microcomputer.

17. Apparatus for controlling drafting means in a textile draw frame or like textile machine according to claim 7 and characterized further in that said adjustable correcting device includes a computer terminal with a display screen.

* * * * *